United States Patent [19]

Andreásson

[11] Patent Number: 4,544,109

[45] Date of Patent: Oct. 1, 1985

[54] ROLL STANDS FOR SIMPLE ROLL REPLACEMENT

[75] Inventor: Bengt A. Andreásson, Åmål, Sweden

[73] Assignee: Aktiebolaget Amals Mekaniska Verkstad, Åmål, Sweden

[21] Appl. No.: 610,573

[22] Filed: May 15, 1984

[30] Foreign Application Priority Data

May 18, 1983 [SE] Sweden ..... 8302792

[51] Int. Cl.[4] ..... B65H 19/08; B65H 19/18

[52] U.S. Cl. ..... 242/58.1; 242/64

[58] Field of Search ..... 242/58, 58.1, 58.2, 242/58.3, 58.6, 64, 68.4, 67.1 R

[56] References Cited

U.S. PATENT DOCUMENTS

| | | | |
|---|---|---|---|
| 2,405,637 | 8/1946 | Behrens | 242/58 X |
| 3,207,452 | 9/1965 | Haskin, Jr. et al. | 242/64 X |
| 3,326,487 | 6/1967 | Huck | 242/64 |
| 3,670,979 | 4/1970 | Seay | 242/64 |
| 3,740,296 | 6/1973 | McDonald | 242/58.1 X |
| 4,196,866 | 4/1980 | Schaffner et al. | 242/58.1 X |
| 4,233,104 | 11/1980 | Fujishima et al. | 242/58.1 X |

*Primary Examiner*—Stuart S. Levy
*Assistant Examiner*—Lloyd D. Doigan
*Attorney, Agent, or Firm*—Murray, Whisenhunt and Ferguson

[57] ABSTRACT

A roll stand for rolls of sheet material allowing exchange of rolls has been invented, wherein the full rolls may be entered into or removed from the roll stand sideways. The roll spindles (16, 17) are at one of their ends journalled stiffly in a first roll holder gable (14), while the other gable (15) comprises at least two supporting arms (26, 27) with supporting bearings (46, 47) for the other ends of the roll spindles. Means (33, 29, 44) are provided to individually loosen the supporting arms from the spindles and moving them aside to make possible the entry or removal of a full roll onto or from the exposed spindle making use of a carriage or the like.

10 Claims, 7 Drawing Figures

61
15
59
62
46
27

ROLL STANDS FOR SIMPLE ROLL REPLACEMENT

TECHNICAL SCOPE

The invention relates to a roll stand for rolls of sheet material allowing exchange of rolls comprising a roll holder for both a roll being unwound or being wound and at least one full roll. Said roll holder comprises two gables attached to a horizontal centre shaft, which is journalled in bearings in a machine frame, and around which the roll holder and the two gables may be turned for change of position. It also comprises two horizontal roll spindles parallel to the centre shaft and journalled in the two gables.

PRIOR ART

Many varieties of roll stands of the above mentioned type allowing exchange of rolls are known. In most cases, their design includes means for accelerating the new roll or the new empty bobbin, as required, to a point where its peripheral speed coincides with the speed of the web or sheet being unwound or being wound, when an exchange of roll is due. Further, they are generally provided with means for cutting the web or sheet being unwound or being wound and for gluing its end to the starting end of the new roll or to the new bobbin, respectively. In the case of a roll stand for unwinding this may be accomplished by bringing the two webs together at the point of the joint to be, using a brush and/or a roll, and when the starting end of the new roll is glued to the web being unwound, a knife is activated to cut the end of the old web. An analogous technique is used for winding stands to glue the cut web end to the new bobbin. Such roll stands allowing roll replacement are highly developed and may require a minimum of floor space. In the patent U.S. Pat. No. 4,194,701 an example of such a roll stand may be found.

Known types of roll stands for unwinding rolls allowing roll replacement do require a considerable amount of floor space in front of the roll stand, however, to accommodate the new roll to be mounted in the stand. This is because according to prior art the new roll must be entered into the stand in the direction of the web or sheet track to a position between the sides of the stand, after which the roll spindle may be entered into the roll and positioned in its bearings in the roll stand sides. It would be desirable to enter the roll in axial direction, as is the case with some simpler roll stands, i.e. roll stands for one roll only. However, this requires that one of the side plates is first removed, which is not possible with roll stands of the known type, since this would mean that the spindle for the roll being unwound would no longer be supported at both ends.

Similar problems exist with stands for winding. Prior art requires handling of loose roll spindles of considerable weight, both in the case of unwinding and of winding.

DESCRIPTION OF THE INVENTION

The purpose of the invention is to offer a solution to the problems mentioned above. In particular a purpose of the invention is to make possible the entry or the removal of a full roll onto or from a roll spindle in axial direction, while simultaneously unwinding or winding, respectively, another roll. Specifically, a roll stand is offered, into which a carriage may be pushed from the side which delivers or receives, respectively, the full roll, which is automatically threaded onto or pulled off, respectively, a roll spindle in axial direction, which makes possible a far-reaching automatization of the roll replacement.

Further, a purpose is to offer a roll stand which also provides such means as are required to accelerate the new roll or the new bobbin, respectively, and for joining the material being unwound or received to the new roll or to the bobbin, respectively. Yet another purpose is to achieve all these purposes which in themselves are difficult to combine without increasing the total amount of space required for the roll stand compared to known roll stands, in which the full roll is entered into or removed from the roll stand in the direction of the running web.

Said purposes of the invention are achieved by making one roll holder gable comparatively stiff, and rigidly connected to the centre shaft, by journalling one end of each of the roll spindles stiffly in said first roll holder gable, by providing the second roll holder gable with at least two supporting arms with supporting bearings for the second ends of the roll spindles, by providing means for loosening said arms individually from the bearing engagement with the second ends of the roll spindles and for moving aside said arms individually in such a way that when one first supporting arm is removed a full roll carried by a carriage or the like may be entered into or removed from the roll stand in an axial direction and be thread onto or pulled off that spindle, the end of which is exposed by removing said first supporting arm, concurrently with the unwinding or rewinding of another roll on another spindle supported by another supporting arm, and by providing means for repositioning said first supporting arm, while, in the case of an unwinding roll stand, the full roll is still supported by the carriage, so that the roll spindle onto which the new roll has been thread is again journalled in said supporting arm, after which the carriage or corresponding device may be removed. In the case of a roll stand for winding the fully wound roll is removed by pulling the carriage out of the roll stand in an axial direction and a new bobbin is placed on the exposed roll spindle, before repositioning the supporting arm into supporting engagement with the roll spindle. The above expression "stiffly journalled" is intended to mean that the roll spindles stay horizontal in spite of their own weight even when they are not supported by any other bearing than the bearing in said first roll holder gable.

The number of supporting arms and roll spindles contained by the roll stand according to the invention may vary, but typically the roll holder comprises two roll spindles and two individually removable supporting arms, which means that the roll stand may simultaneously hold two rolls. It is possible to conceive a roll stand with roll holders for three rolls simultaneously, which would mean three roll spindles and three supporting arms, which would preferably be arranged symmetrically in triangular form in a conventional manner. In any case, that roll spindle which corresponds to the first supporting arm is positioned approximately level with the turning axis of the centre shaft, according to the preferred embodiments, at the time of exposing the end of a roll spindle by removing said supporting arm in order to thread a full roll onto said spindle or to remove a full roll therefrom. The means for accelerating the new roll or the new bobbin and the means for cutting the web and the means for joining the cut end to the new roll or to the bobbin, at the time of roll replacement, are on the other hand preferably arranged in the upper part of the roll stand, at which stage said first supporting arm, supporting that roll spindle which carries the just threaded new roll or bobbin, is being oriented generally vertically.

The general scope of the invention comprises different ways to loosen the first supporting arm and removing it from its engagement with the first roll spindle in order to make possible the entry of the new roll or bobbin in the direction of the spindle. It is conceivable, for example, to remove the first supporting arm in its own longitudinal direction in the same way as is done with simple roll stands. This solution, however, has serious drawbacks in the case of a roll stand which shall allow roll replacement. According to the preferred embodiment, said means for disengaging and removing the first supporting arm instead comprises means for first moving the arm generally axially, i.e. in the direction of the roll spindle away from the spindle, so that the end of the roll spindle slides out of the supporting bearing in the outer end of the supporting arm, and means for forcing the supporting arm to pivot upwards around a turning axis at the inner end of the supporting arm. This preferred embodiment specifically comprises a turning axis journalled in a side plate rigidly affixed to the centre shaft, which plate is arranged to be turned around the turning axis of the centre shaft together with the centre shaft when the roll holder is turned to change the roll position. Further, this embodiment comprises a symmetrical, lateral displacement of the turning axes of the supporting arms relative to the turning axis of the centre shaft. The turning axes of the supporting arms are parallel to the turning axis of the centre shaft. In order to force the first supporting arm upwards as it pivots said axially working means are employed in combination with a link coupling between the centre shaft side plate and the supporting arm. Said link coupling preferably comprises a member which extends between one first bearing in the centre shaft side plate, positioned beyond the turning axis of the supporting arm as viewed from the turning axis of the centre shaft, and one second bearing on the supporting arm positioned between the turning axis of the supporting arm and the supporting bearing. When the supporting arm is moved back into engagement with that roll spindle which now carries the new roll or the new bobbin it moves along the same path in the space between the side of the new roll or bobbin and the frame of the carriage beside the roll stand.

Further characteristics and advantages of the invention will be apparent from the following description of a preferred embodiment, which by way of example relates to an unwinding roll stand, as well as from the patent claims to follow.

BRIEF DESCRIPTION OF DRAWINGS

In the following description of a preferred embodiment of a roll stand for unwinding rolled material reference will be made to the attached drawings, of which

DESCRIPTION OF A PREFERRED EMBODIMENT

Figure 1:
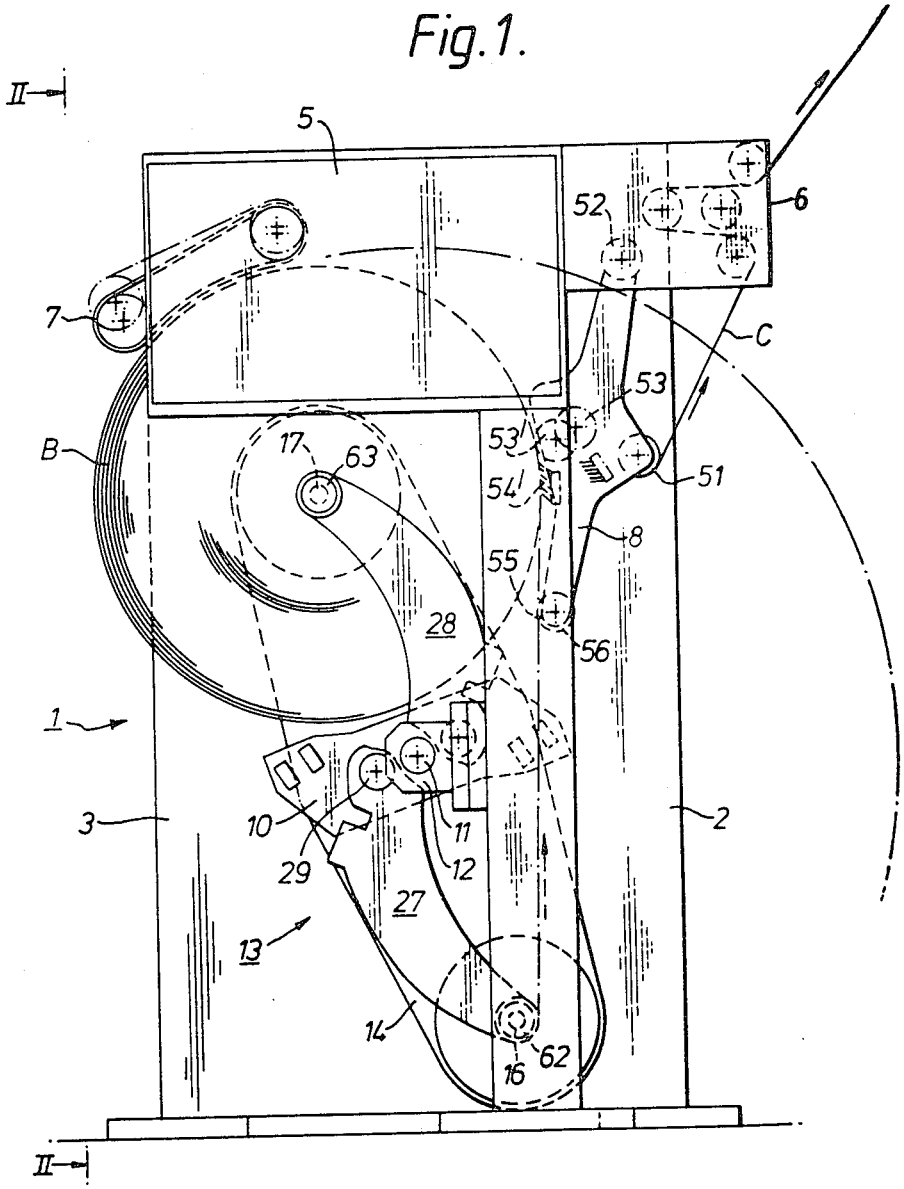
FIG. 1 is a side elevation view of the roll stand according to the invention in position for roll replacement, i.e. when the tail end of a web being unwound is to be joined to the head end of a new roll.
Figure 2:
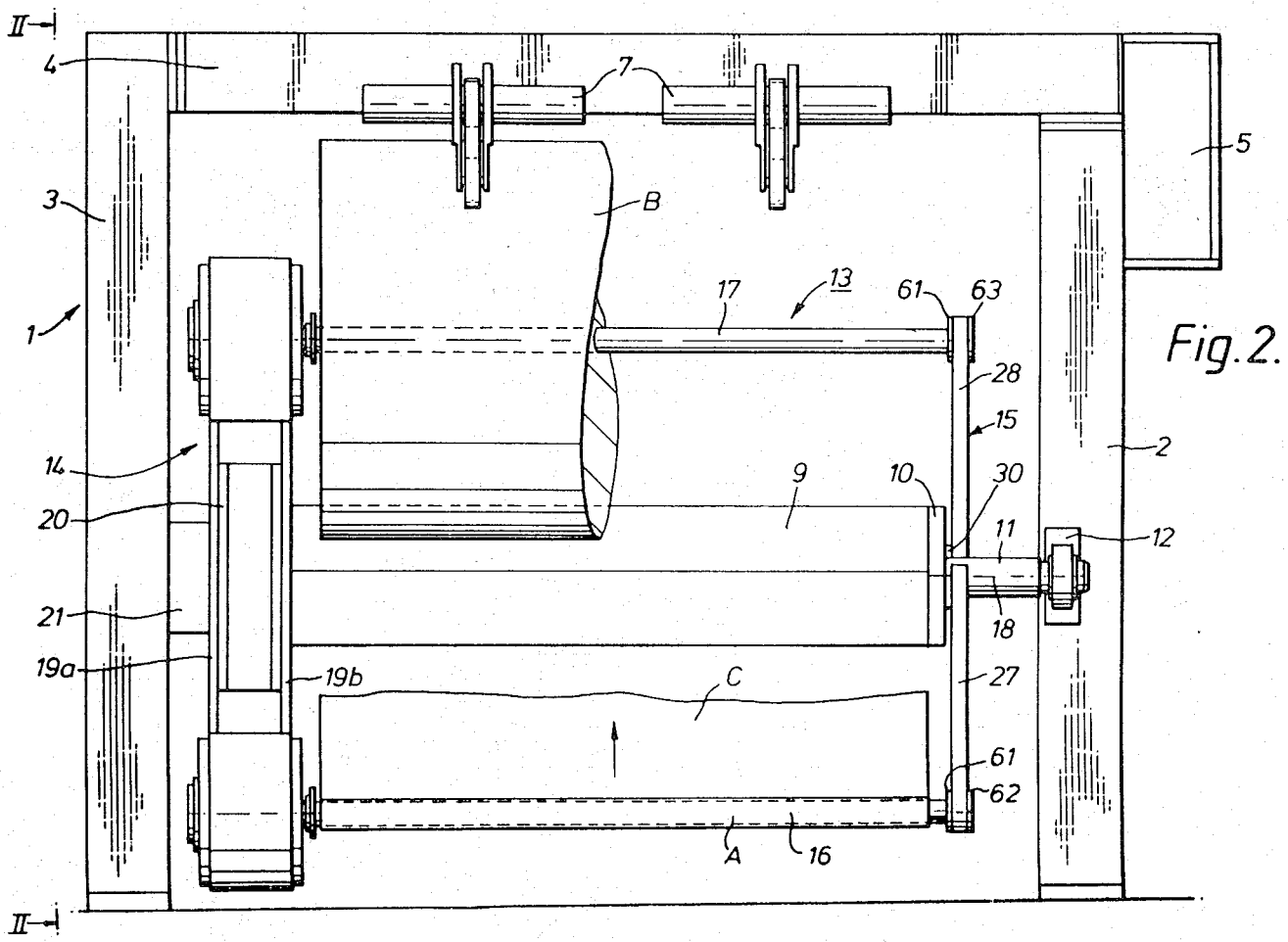
FIG. 2 is a side elevation view as seen in the direction marked II—II in FIG. 1.
Figure 3:
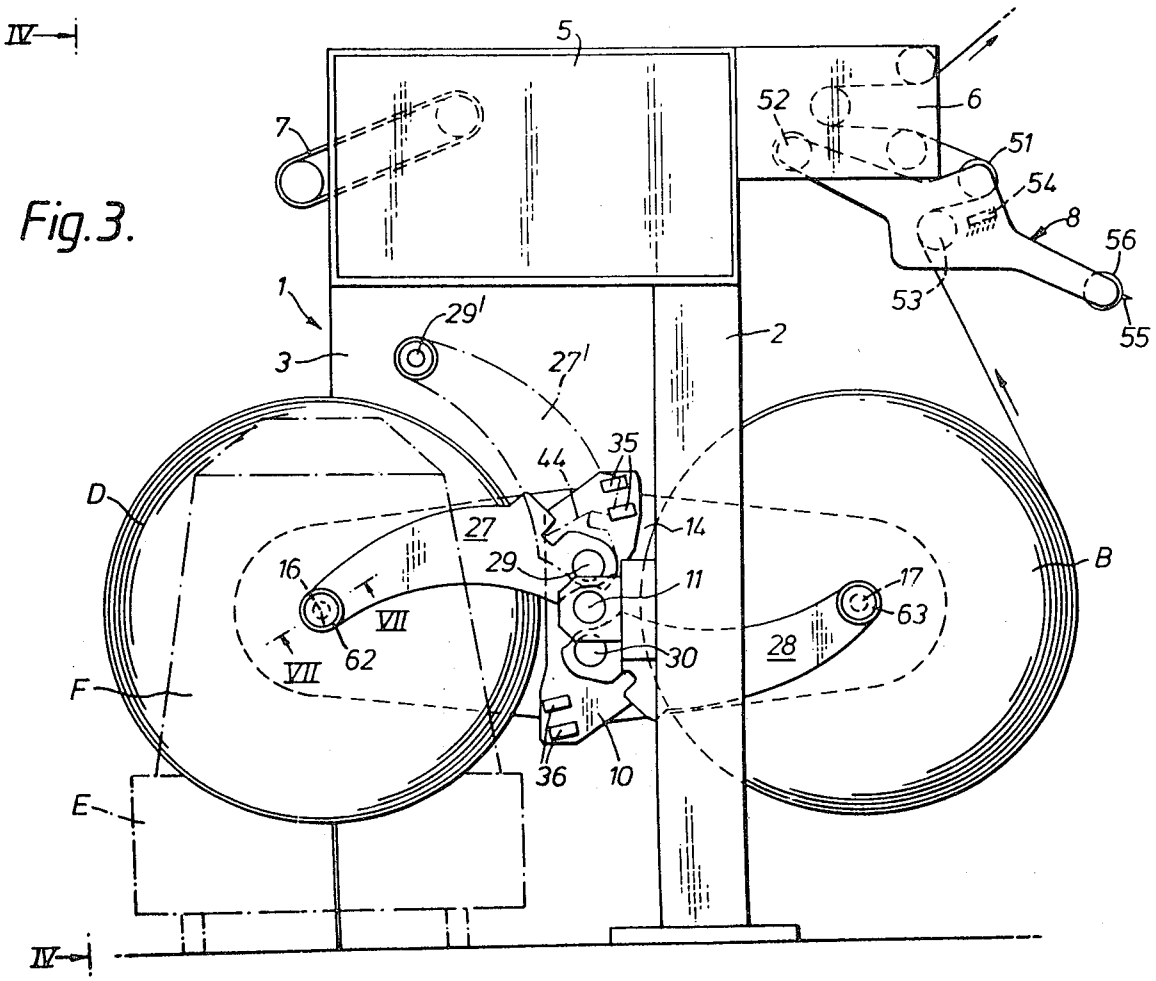
FIG. 3 is a side elevation view showing the roll stand with the roll holder in that position which it takes immediately after receiving a new roll.
Figure 4:
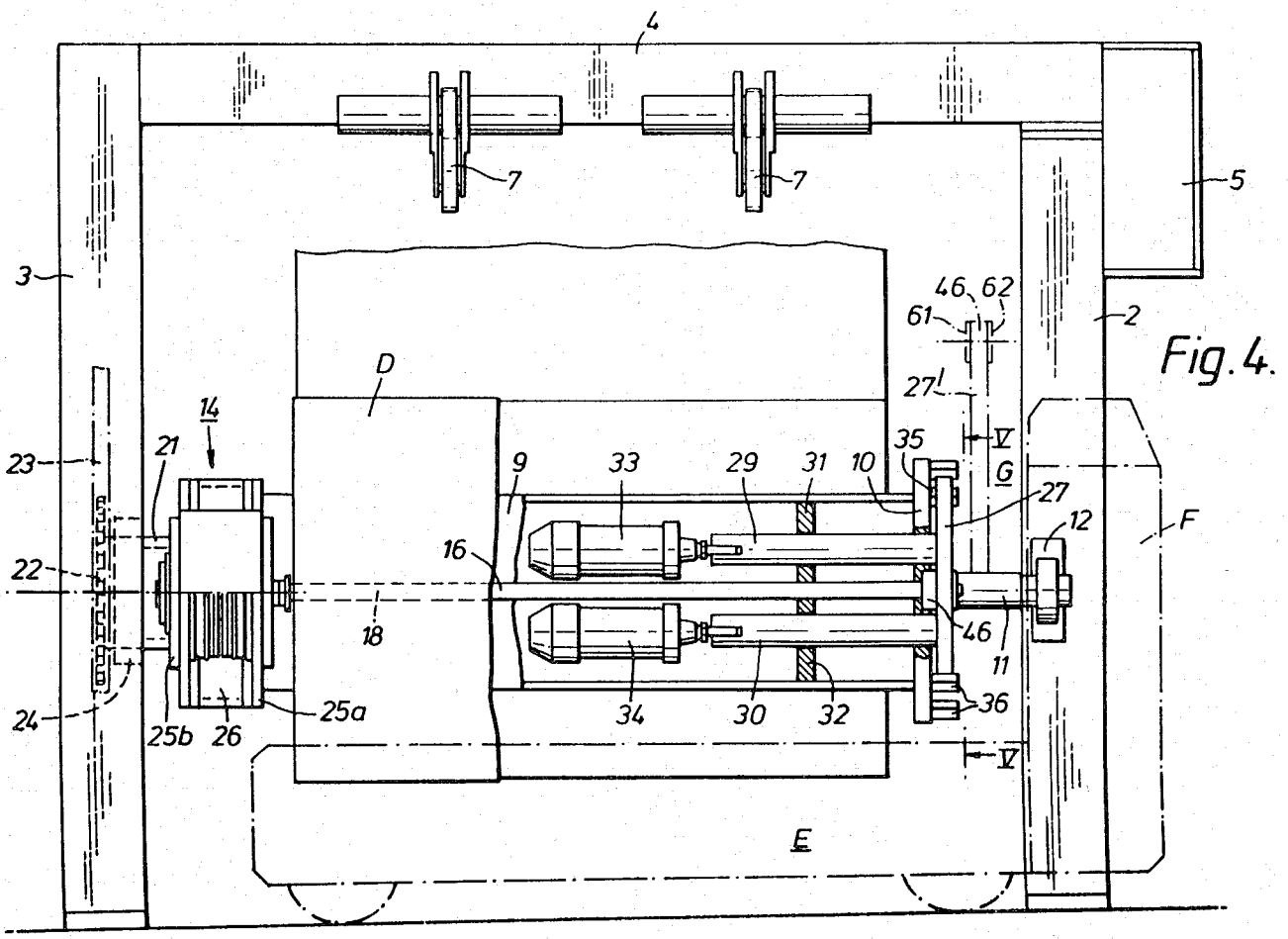
FIG. 4 is a side elevation view in the direction IV—IV in FIG. 2.

In the FIGS. 1-4 a machine frame has been designated 1. The frame comprises a pillar 2, which in FIG. 1 and FIG. 3 is in the foreground and in FIG. 2 is to the right. On the opposite side, i.e. on the left part of the frame, there is a vertical column 3. The pillar 2 and the left column 3 are connected by an upper beam 4. The parts 2, 3 and 4 of the frame carry a box 5, which contains electric equipment. An exchange device 8 (shown only in FIGS. 1 and 3) is carried by brackets 6 mounted onto the beam 4. Means for acceleration are designated 7. A centre shaft with rectangular section has been designated 9. In FIG. 2 the edge of this centre shaft is turned towards the viewer, while FIG. 4 shows the full side of the centre shaft 9 (partly cut away). At the right end of the centre shaft 9 is an end plate 10 with a gudgeon 11, which is journalled in a bracket bearing 12 in the right hand pillar 2. In other words the pillar 2 is disposed beside the centre shaft 9, specifically beyond the centre shaft as viewed in the direction of a sheet or web flow. The material flow direction is rightward in FIG. 1.

The centre shaft 9 is a central part of a roll holder, generally designated 13, comprising beside the centre shaft 9 one first (left side) roll holder gable 14, one second (right side) roll holder gable 15, FIG. 2, and one first and one second roll spindle 16 and 17, respectively, between the two gables 14 and 15. The turning axis inside the centre shaft 9 of the roll holder 13 is designated 18. The left roll holder gable 14 is rigidly connected to the centre shaft 9 and consists of two side plates **19*a* and 19*b*, FIG. 2, which form a box-like construction. Between the side plates 19*a* and 19*b* there is an inner box 20 connected to the side plates 19*a* and 19*b*, which has a tube shaped horizontal gudgeon 21 directed leftward, equipped with a pinion 22 at its outer left end. A chain 23 is connected to a motor (not shown) for turning the roll holder 13 around its turning axis in order to change its position. The gudgeon 21 is journalled in a bearing 24 in the left hand part 3 of the machine frame 1**.

The two roll spindles 16 and 17 are stiffly journalled in the first, left, roll holder gable 14. For this purpose the two side plates **19*a* and 19*b* are equipped with two pairs of bearings, bearings 25*a* and 25*b* journalling roll spindle 16. Apart from this the first gable 14 contains a pair of braking devices 26, positioned between the side plates 19*a* and 19*b*. The expression "stiffly journalled" is intended to mean that the roll spindle stays horizontal even when only supported by the two bearings in the left roll holder gable 14 (for spindle 16 this means the two bearings 25*a* and 25*b***), at least when the journalling arrangement does not have to carry more than the weight of the roll spindle plus that of a bobbin and a smaller amount of unwound sheet material.

The other, right-hand side roll holder gable 15 consists of two arms, a first supporting arm 27 and a second supporting arm 28. The outer ends of these arms carry supporting bearings 46 and 47 for the roll spindles 16 and 17, respectively. The supporting bearings are covered by lids 62 and 63, respectively. Each of the supporting arms 27 and 28 are equipped with a shaft 29 and 30, respectively. The shafts 29 and 30 are rigidly attached to the supporting arms 27 and 28 for example by welding and are journalled in the end plate 10 of the centre shaft 9. The shafts 29 and 30 extend further into the centre shaft 9, see FIG. 4. The shafts are supported by a pair of supporting bearings 31 and 32, respectively, inside the centre shaft 9. The shafts 29 and 30 may turn around their centre axes and may also be displaced axially. This axial displacement is accomplished by hydraulic cylinders 33 and 34, respectively, the piston rods of which are connected to the inner ends of the shafts 29 and 30, respectively.

Figure 5:
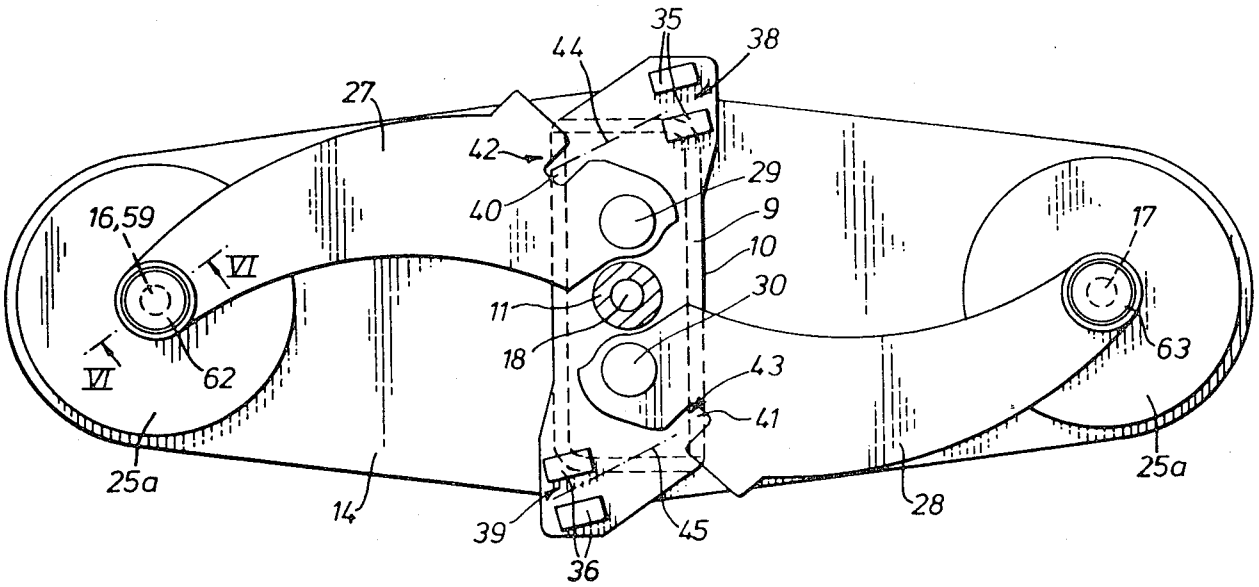
FIG. 5 is a side elevation view of a detail of the roll stand as seen in the direction V—V in FIG. 4.
Figure 6:
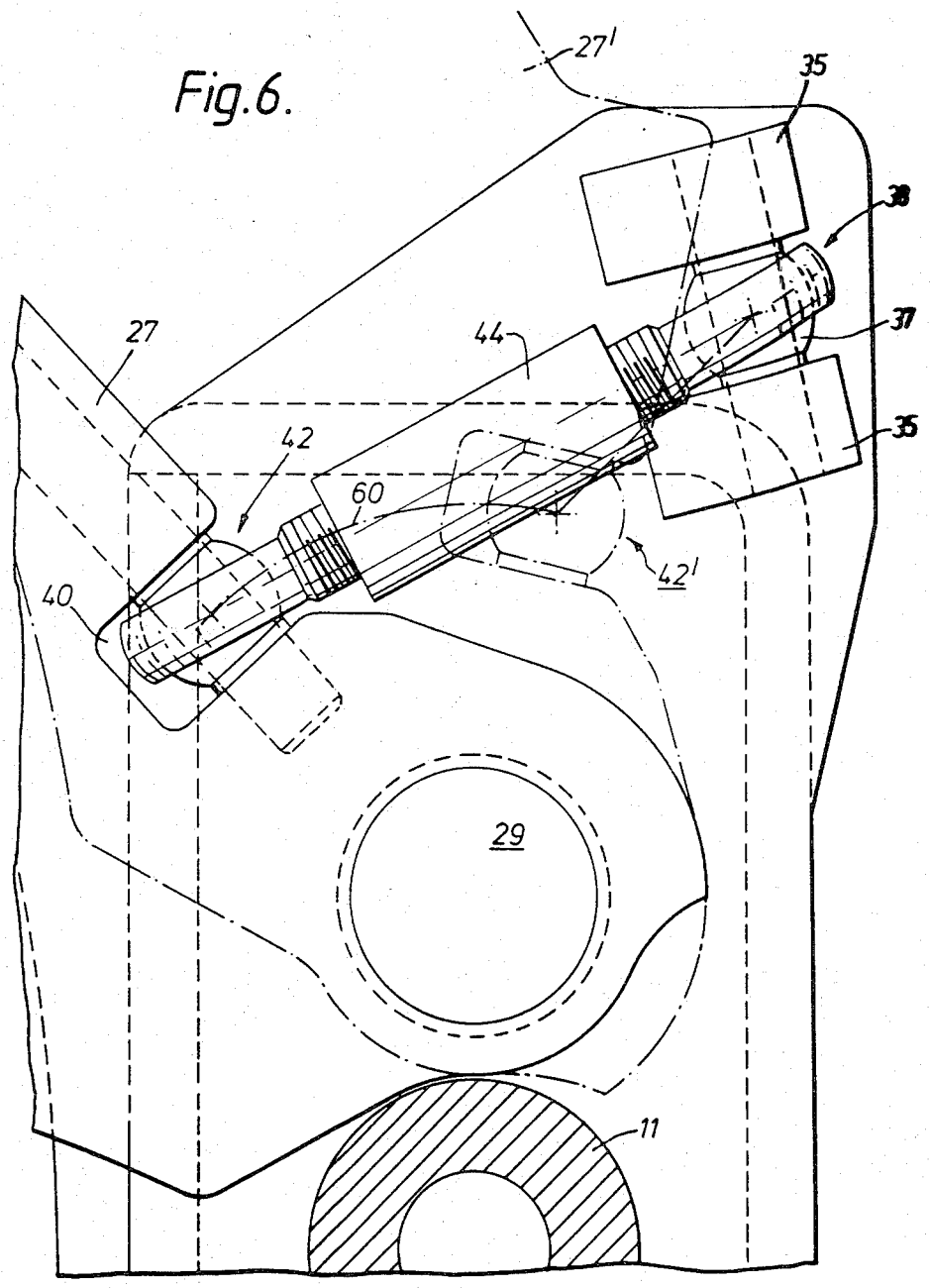
FIG. 6 shows the construction of a link coupling which is part of the apparatus.
Figure 7:
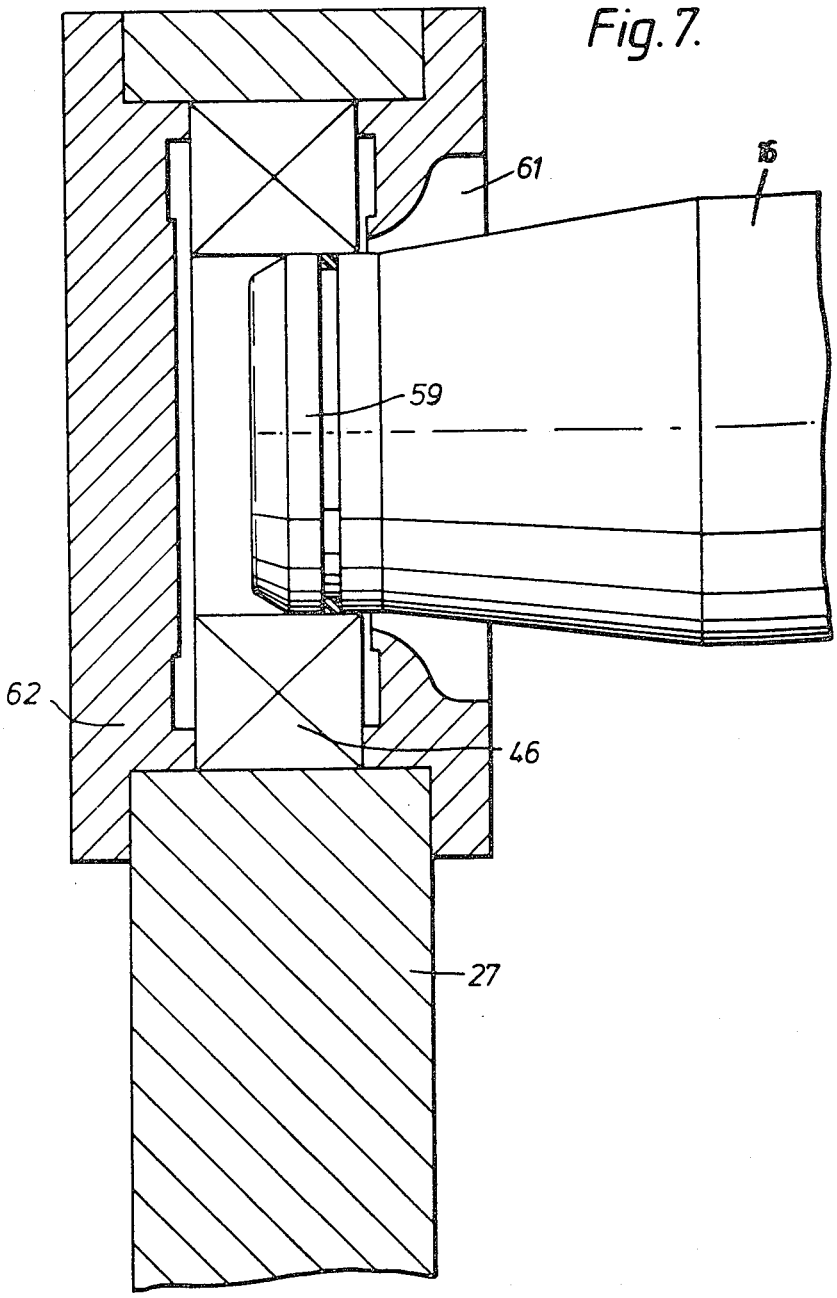
FIG. 7 is a sectioned view along VII—VII in FIG. 3 and shows the construction of the supporting bearing of one supporting arm and of the end of the corresponding roll spindle.

The end plate 10 of the centre shaft is equipped with two pairs of lugs 35 and 36 at its outer end, see FIG. 5 and FIG. 6. Between the lugs in the lug pair 35 extends a shaft with a spherically formed centre part 37, which is intended to accomodate a first link bearing 38. A corresponding link bearing 39 is placed between the lugs 36, see FIG. 5. The link bearings 38 and 39 are located peripherally to the shafts 29 and 30 of the supporting arms compared to the turning axis 18 of the centre shaft.

In the supporting arms 27 and 28 there are recesses 40 and 41, across which extend link bearing shafts with spherical centre parts corresponding to the centre parts 37 of the first link bearings 38 and 39. These second link bearing shafts with their centre parts form bearings 42 and 43. The connective link between the bearings 38 and 42 and between the bearings 39 and 43, respectively, are the stiff members 44 and 45, respectively, journalled on the spherical parts.

Other parts of the equipment will become apparent from the following description of the working mode of the roll stand. The starting position of one working cycle for the roll stand may be that of FIG. 1 and FIG. 2. The roll holder 13 is in position for roll replacement with the two supporting arms 27 and 28 almost vertically. More specifically, the first supporting arm 27 is in a five o'clockposition and the other roll holder arm is in an eleven o'clockposition. The lower first roll spindle carries a roll A, which is almost completely unwound and the upper second roll spindle 17 holds a full roll B. The sheet material C runs from the roll A up to the exchange unit 8, which has been turned towards roll B by turning around axis 52. The sheet C continues from a turning roll 51 in exchange unit 8 to a system of sheet tensioning rolls in unit 6 and then leaves the roll stand. The exchange unit 8 also comprises a pressure roll 53, a brush 54 with the same length as the width of sheet C, and a knife 55 mounted on a roll 56 in the lower part of the exchange unit 8. The pressure roll 53 and the brush 54 may be displaced into exchange positions 53' and 54', respectively, by means of hydraulic cylinders (not shown). When the units 53' and 54' press the sheet C towards the new roll B, on the outside of the head end of which has been applied glue, the sheet C sticks to said head end, after which the sheet C is immediately cut by the knife 55. Before this the roll B has been accelerated to the same peripheral speed as the running speed of the sheet C by means of the acceleration unit 7. By cutting the sheet C with the knife 55 and gluing it by using the pressure roll 53 and the brush 54 in the respective positions 53' and 54' the cut tail end of the sheet C has been joined to the head end of the new roll B, which immedately starts being unwound. Roll replacement is now completed and the exchange unit is turned to its position shown in FIG. 3 by turning around its axis 52. The acceleration unit 7 returns to the position indicated by dashed lines in FIG. 1.

The next step is to turn—to index—the roll holder around the centre axis 18 using the turning motor (not shown), the chain 23, and the pinion 22, see FIG. 4. This turning is continued until the two roll spindles 16 and 17 are level with the turning axis 18 of the centre shaft 9, see FIGS. 3 and 4. The first roll spindle 16 is now in position to be to receive a new roll D. Before this, the first supporting arm 27 in the second roll holder gable 15 must be moved aside in order to remove the remaining bobbin from roll A. The supporting arm must be moved so far aside that a new full roll D may be entered into the roll stand axially onto the exposed roll spindle.

According to the invention this is accomplished by the means for displacement comprising hydraulic cylinder 33, shaft 29, and member 44. The latter is indicated in FIGS. 3 and 5 by a chain-dotted line. When the piston of cylinder 33 moves the shaft 29 outwards, i.e. to the right in FIG. 4, the supporting arm 27 is displaced initially sideways without any substantial turning around the centre of shaft 29. By this displacement the supporting bearing 46 of the supporting arm 27 is removed from its engagement with the end 59 of the spindle 16. The supporting bearings 46 are spherical ball bearings, which may adjust to misalignment compared to the centre shaft of the bearing, which makes it possible to compensate for the small twisting of supporting arm 27, which actually takes places during this initial stage. When the supporting arm 27 is no longer in engagement with the roll spindle 16, and as the axial outward movement of the shaft 29 continues, the link member 44 forces the supporting arm 27 to turn around the centre axis of shaft 29. This is obviously a result of the fact that the length of link member 44, i.e. the distance between the centre points of link bearings 38 and 42, is constant. As the link bearing 42 is displaced outwardly along with the supporting arm 27, it must also be turned along a curve, which in FIG. 6 is indicated by the number 60. The end position of the link bearing 42 is position 42' of FIG. 6, which corresponds to the end position 27' of supporting arm 27, indicated in FIGS. 3, 4 and 6. The supporting arm 27 in other words reaches its end position 27' after having moved both outwardly and upwardly.

As the arm 27 has been moved to position 27', the bobbin and the remaining material from the newly unwound roll A is removed. This may be carried out manually or by means of a specially designed carriage which enters the roll stand from the side, axially. Such a carriage may be equipped with a gripping device which grips the bobbin, after which the carriage is reversed out of the roll stand with the bobbin and remaining sheet material. After this, the new roll D may be entered onto the exposed roll spindle 16. The roll D is preferably entered by means of a carriage E. The position of the roll D is first corrected horizontally and vertically as required, into exact position for being thread onto roll spindle 16. The carriage E is equipped with a drive and maneuvering unit F, which may take the position indicated in FIG. 4. While the carriage E is still carrying the full roll D and the unwinding of roll B is continuously going on, the supporting arm 27 is now to be placed back into engagement with the roll spindle 16. The return movement takes the opposite direction to the one just described. In other words the arm 27 is turned down in the space G, between the new roll D and the vertical part of the carriage E. At the end of this movement the link 44 forces the arm 27 to move, substantially without being turned, inwards towards the roll spindle 16. Because the end 59 of the roll spindle is conically tapered, and because there is a conical guide 61 inside the supporting bearing 46, said bearing is automatically guided onto the end 59 of the roll spindle 16. In the end position, which corresponds to the starting position, the hydraulic cylinder has pulled the shaft 29 inwards, so that the link 44 is parallel to the supporting arm 27. This means that even if the cylinder 33 should cease to function, the supporting arm 27 would not unintentionally be removed from its resumed starting position, since this position is stable.

When the supporting arm 27 is back in place, the carriage E may be lowered and removed axially from the roll stand. The unwinding of roll B continues. When roll B is almost unwound, the indexing of the roll holder is continued by turning it around the centre axis 18 of the centre shaft 9 clockwise with respect to FIG. 3 until the second roll spindle 17 has reached exchange position and the roll D has been turned up towards the acceleration unit 7. Then the new roll D is accelerated, and the exchange unit 8 is turned down around its axis 52, after which a roll exchange can take place again as was described earlier with respect to FIGS. 1 and 2.

I claim:

1. A roll stand for rolls of sheet material wound on bobbins, each bobbin having an axis and an axial hollow core, allowing exchange of a bobbin in a first position, having a full roll of sheet material wound thereon with an empty bobbin in a second position, said roll stand comprising roll holder means, having an axis of rotation, for supporting a bobbin having a full roll of sheet material wound thereon in a first position and supporting an empty bobbin in a second position, said roller holder means rotatable about said axis of rotation to exchange said bobbin having a full roll of sheet material in said first position with said empty bobbin in said second position; and machine frame means for supporting said roll holder means for rotation about said axis of rotation; wherein said roll holder means comprises:

a horizontal center shaft having an axis, said center shaft journalled in bearings in said machine frame means for rotation about said center shaft axis;

a first gable and a second gable, said first and second gables being horizontally spaced apart and connected to said horizontal center shaft for rotation therewith;

at least two spaced apart horizontal roll spindles, each roll spindle having an axis parallel to said center shaft axis and being rotatable about said axis, each spindle having a first end and a second end, said first ends rotatably supported by said first gable and said second ends rotatably supported by said second gable, each of said spindles cocoaxially receivable within the axial hollow core of a respective bobbin, said bobbins rotatable together with said respective spindles;

said first gable rigidly connected to said center shaft, said first ends of said spindles stiffly journalled in said first gable;

said second gable comprising at least two supporting arms, each supporting arm having an inner end and an outer end, said outer end provided with a support bearing detachably connected to said second end of a respective spindle for supporting said second end, said supporting arms being individually movable between a first arm position, wherein said support bearing is connected to said second end of a respective spindle for support thereof, and a second arm position, wherein said support bearing is detached from said second end of the respective spindle and said arm is moved aside so as to not interfere with the axial movement of a bobbin having a full roll of sheet material wound thereon when said bobbin is coaxially aligned with said respective spindle; and activating means for moving said arms individually between said first position and said second position.

2. The roll stand according to claim 1, wherein said second gable comprises two supporting arms; the two roll spindles which are supported by said arms are substantially diametrically opposed on opposite sides of said center shaft axis; and said center shaft is rotated until said spindles are at least approximately level with said center shaft axis when movement of one of said supporting arms from said first position to said second position is effected.

3. The roll stand according to claim 1, wherein the center shaft is rotated until the spindle connected to the support arm which is to be moved from said first position to said second position is approximately level with said center shaft axis, when movement of one of said supporting arms from said first position to said second position is effected.

4. The roll stand according to claim 1 wherein said activating means comprises first means for moving said supporting arm axially, with respect to said spindle, to detach said spindle from said support bearing; and second means for thereafter forcing said supporting arm to rotate about a turning axis perpendicular to said supporting arm, said turning axis being proximate the inner end of said supporting arm.

5. The roll stand according to claim 1, further comprising a respective shaft having an axis rigidly connected to the inner end of each of said supporting arms, each said shaft substantially perpendicular to said supporting arm and extending toward said first gable, each said shaft slidably and rotatably received within a respective aperture formed in an end plate rigidly attached to said center shaft for rotation therewith.

6. The roll stand according to claim 5, wherein said shaft axes are disposed symmetrically about said center shaft axis and parallel thereto.

7. The roll stand according to claim 6, further comprising actuator means for moving said shaft axially, with respect to said center shaft axis.

8. The roll stand according to claim 7, further comprising link coupling means, connecting said end plate and said supporting arm, for forcing rotation of said supporting arm about said shaft axis after upon axial movement of said shaft.

9. The roll stand according to claim 8, wherein said link coupling means comprises a first link bearing on said end plate, said first link bearing located outboard of said shaft axis relative to said center shaft axis; a second link bearing on said supporting arm; and a rigid link member having first and second ends, said first end journalled about first link bearing and said second end journalled about said said second link bearing.

10. The roll stand according to claim 1, further comprising means for rotationally accelerating a bobbin coaxially received on a respective spindle for rotation together with said respective spindle.

* * * * *